US008424729B2

(12) United States Patent
Verneau

(10) Patent No.: US 8,424,729 B2
(45) Date of Patent: Apr. 23, 2013

(54) GARMENT CLIPPING HANGER

(75) Inventor: Olivier Verneau, Nice (FR)

(73) Assignee: Idey, Nice (FR)

( * ) Notice: Subject to any disclaimer, the term of this patent is extended or adjusted under 35 U.S.C. 154(b) by 0 days.

(21) Appl. No.: 13/003,310

(22) PCT Filed: Jul. 2, 2009

(86) PCT No.: PCT/FR2009/000817

§ 371 (c)(1),
(2), (4) Date: Apr. 18, 2011

(87) PCT Pub. No.: WO2010/004129

PCT Pub. Date: Jan. 14, 2010

(65) Prior Publication Data

US 2011/0180572 A1 Jul. 28, 2011

Related U.S. Application Data

(60) Provisional application No. 61/139,939, filed on Dec. 22, 2008.

(30) Foreign Application Priority Data

Jul. 9, 2008 (FR) ..... 08 54660

(51) Int. Cl.
*A41D 27/22* (2006.01)

(52) U.S. Cl.
USPC ..... 223/96; 223/95

(58) Field of Classification Search ..... 223/85, 223/91, 95, 96
See application file for complete search history.

(56) References Cited

U.S. PATENT DOCUMENTS

| | | | | |
|---|---|---|---|---|
| 2,212,524 | A * | 8/1940 | Huff | 223/96 |
| 3,152,737 | A * | 10/1964 | Cates | 223/96 |
| 3,950,829 | A * | 4/1976 | Cohen | 223/96 |
| 4,231,500 | A * | 11/1980 | Mainetti | 223/96 |
| 6,116,482 | A * | 9/2000 | Heiber | 223/96 |
| 2004/0065702 | A1 * | 4/2004 | Yang | 223/96 |
| 2004/0094582 | A1 | 5/2004 | Schapiro et al. | |
| 2005/0224532 | A1 | 10/2005 | Russo | |
| 2006/0091166 | A1 | 5/2006 | Suggitt | |

OTHER PUBLICATIONS

Int'l. Preliminary Report on Patentability and Written Opinon issued on Mar. 1, 2011 in Int'l. Application No. PCT/FR2009/000817.
Int'l Search Report issued on Jun. 9, 2010 in Int'l Application No. PCT/FR2009/000817.
Written Opinion issued on Jun. 9, 2010 in Int'l Application No. PCT/FR2009/000817.

* cited by examiner

*Primary Examiner* — Nathan Durham
(74) *Attorney, Agent, or Firm* — Panitch Schwarze Belisario & Nadel LLP

(57) ABSTRACT

A hanger for garments includes arms able to be moved apart or brought nearer and an elastic mechanism arranged to hold, at least partially, the arms one against the other so as to allow a garment to be held by clipping. A control mechanism is intended to move the arms away from one another, and includes an operating element arranged on one of the arms and accepting at least one degree of freedom in relation to this arm so as to be able to be operated by the hand of the user holding the hanger. The hanger may be applied to hang garments by clipping, in particular pants or skirts.

14 Claims, 10 Drawing Sheets

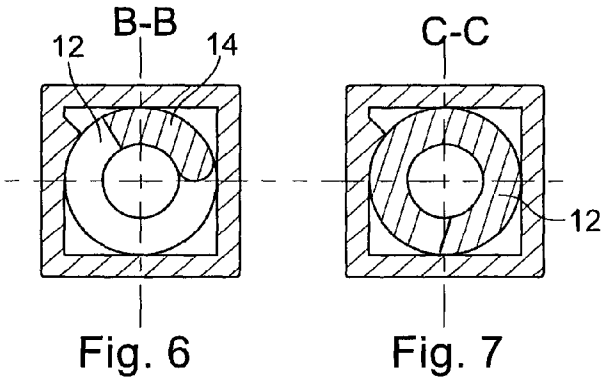
Fig. 7
Fig. 6
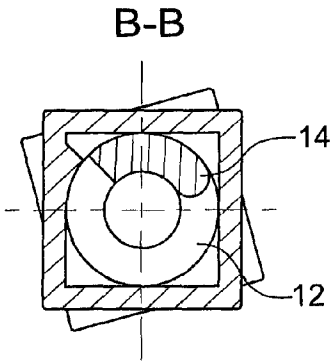
Fig. 9
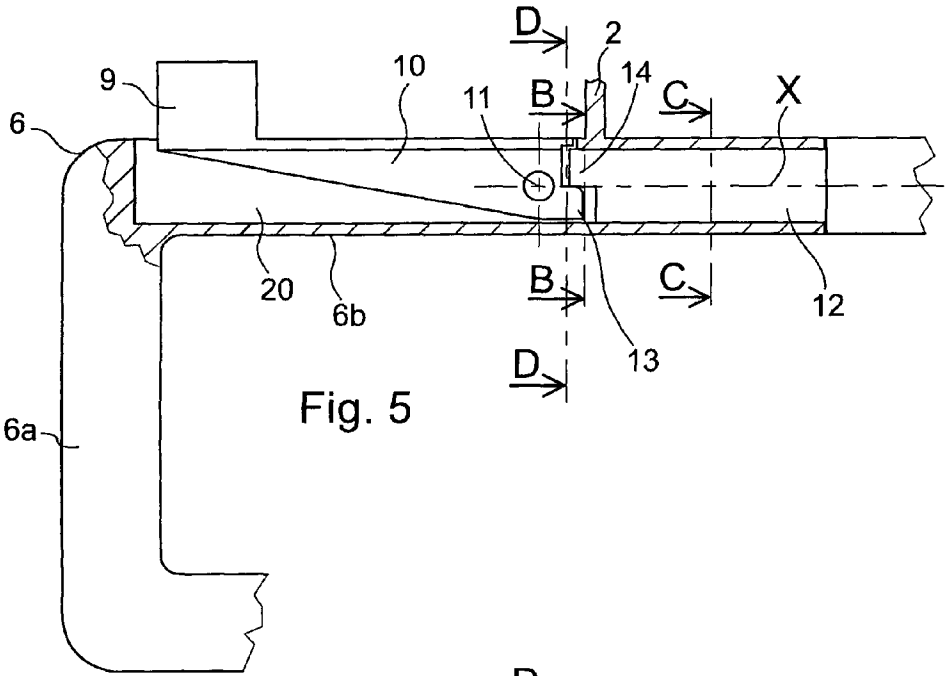
Fig. 5
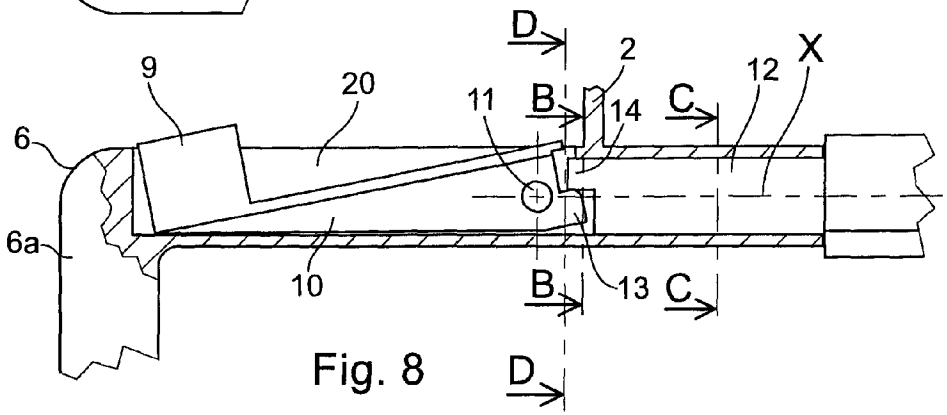
Fig. 8

GARMENT CLIPPING HANGER

CROSS-REFERENCE TO RELATED APPLICATIONS

This application is a Section 371 of International Application No. PCT/FR2009/000817, filed Jul. 2, 2009, which was published in the French language on Jan. 14, 2010, under International Publication No. WO 2010/004129 A8 and the disclosure of which is incorporated herein by reference.

BACKGROUND OF THE INVENTION

Embodiments of the present invention relate to a hanger intended to hold a garment by clipping and provided with a control mechanism. Embodiments of the invention apply in particular to the suspension of garments by clipping, in particular pants or skirts.

Several models of hangers of the clipping type are known, with two arms to clip garments. According to a type of these models, both arms, for example in wood, are linked by a metal hook used at the same time for suspension and as a lever for bringing both arms away or closer. These hangers are usually not easy to use. In fact, the user must at the same time hold the hanger, operate the lever to lock or unlock the arms, mutually bring the arms away or closer and position the garment between both arms. To perform these various operations nearly simultaneously proves to be difficult. In addition, it is also very tricky to perform these operations with both hands only.

Handling the hanger being complicated, there is also a risk to get a finger caught between the arms when closing. The force generated at the level of the arms is high enough to make this situation very unpleasant for the user.

There is therefore a need for a hanger for holding a garment by clipping, which is easy to use and highly secure.

BRIEF SUMMARY OF THE INVENTION

One embodiment relates to a hanger for garments including: two arms, each having a clipping stick, both arms being mobile one in relation to the other between an open position where the two clipping sticks are moved apart from one another and a clipping position where they are one against the other, an elastic mechanism for returning the arms in the clipping position, to generate a clipping force between the clipping sticks, to allow a garment to be held by clipping, and a control mechanism to bring the arms in the open position, against the elastic mechanism, under the effect of pressure exerted on the control mechanism. According to one embodiment, the control mechanism is mounted mobile on a first of the arms, so as to be able to be operated by pressure exerted by the hand of the user holding the first arm, the elastic mechanism bringing the arms towards the clipping position in the absence of pressure exerted on the control mechanism.

According to one embodiment, each clipping stick has an elongated shape comprising a free end located in clipping position near the non-free end of the other clipping stick.

According to one embodiment, each arm comprises a linking stick attached to a non-free end of the clipping stick, the linking sticks being rotatively fixed between them around a rotation axis.

According to one embodiment, the rotation axis of the arms is substantially parallel to a longitudinal axis of the clipping sticks.

According to one embodiment, the ends of the linking sticks fixed to one another are formed to mutually cooperate so as to form a pivot link centered on the rotation axis.

According to one embodiment, the linking stick of one of the arms is formed to act as an area for handling and holding the hanger by the hand of the user.

According to one embodiment, the linking stick of one of the two arms is provided at its end intended to be linked to the linking stick of the other arm, with a cylinder part intended to be inserted into the linking stick of the other arm and cooperating with the operating element.

According to one embodiment, the operating element accepts in relation to the first arm at least one degree of freedom in rotation.

According to one embodiment, the operating element accepts in relation to the first arm at least one degree of freedom in translation according to a direction substantially parallel to the rotation axis.

According to one embodiment, the elastic mechanism includes a spring having a first end in contact with the first arm and a second end in contact with the second arm to exert on the arms a force tending to bring and hold both arms in the clipping position.

According to one embodiment, the operating element includes an extension intended to cooperate with a contact area attached to the second arm so that operating the operating element drives one of the two arms in rotation in relation to the other around the rotation axis.

According to one embodiment, the operating element includes a part of conical tooth gear to cooperate with a part of conical tooth gear of complementary shape arranged on the second arm so that operating the operating element drives the second arm in rotation around the rotation axis.

According to one embodiment, the operating element is formed to allow stress to be reduced between the extension and the support area so that the stress exerted on the support area, necessary to move the arms apart, is significantly lower than the maximal stress which may usually exert on a user by flexing his/her thumb.

According to one embodiment, the second arm is formed to reduce the relative travel of the clipping stick of the second arm in relation to the travel of the contact area.

According to one embodiment, the hanger comprises an indicator specifying the number of times the garment has been worn.

Thus, thanks to these measures, the user may hold the hanger with one hand with which s/he may also operate the control mechanism which opens the two arms, then allowing the user to slip his/her garment between both arms using his/her other hand. Once the garment is properly placed between both arms, the user releases the pressure exerted on the control mechanism. The elastic mechanism then moves the two arms back to their clipping position in which the garment is held.

Embodiments of the invention thus allow the use of clipping hangers to be significantly facilitated.

The aim of the present application is also to protect, in a different way than the hanger previously defined, a hanger for garments including: a fixed arm having a fixed clipping stick, a mobile arm having a clipping stick mobile between an open position away from the fixed clipping stick and a clipping position against the fixed clipping stick, an elastic mechanism for returning the mobile clipping stick in the clipping position, to generate a clipping force between the clipping sticks, to allow a garment to be held by clipping, and a control mechanism to bring the mobile clipping stick away from the fixed clipping stick, against the elastic mechanism, under the effect of pressure exerted on the control mechanism. According to one embodiment, the mobile arm and the fixed arm each include a linking stick attached to a non-free end of the clipping stick, the linking sticks being rotatively fixed between them around a rotation axis, the clipping sticks each having an elongated shape comprising a free end located in clipping position near the non-free end of the other clipping stick.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings:

FIG. 5 is a view partially in longitudinal section of a part of the hanger shown in FIG. 1, according to a first embodiment, showing a position of a control mechanism when it is not operated.

FIGS. 6 and 7 are views of the part of hanger according to the sections B-B and C-C of FIG. 5, FIG. 8 is a front view partially in longitudinal section of a part of the hanger shown in FIG. 1, according to a first embodiment, showing a position of the control mechanism when it is operated, FIG. 9 is a view according to the section B-B of the part of hanger of FIG. 8.

DETAILED DESCRIPTION OF THE INVENTION

Figure 1:
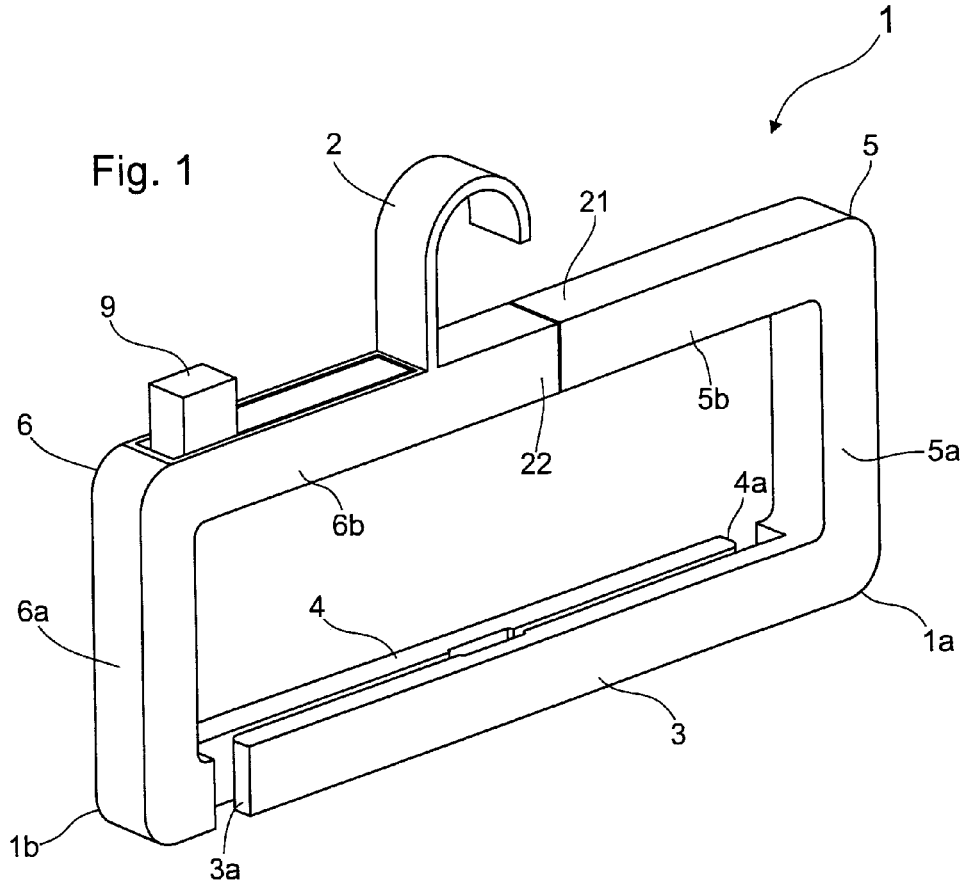
FIG. 1 is a perspective view of a hanger according to an example embodiment of the invention in clipping position.
Figure 2:
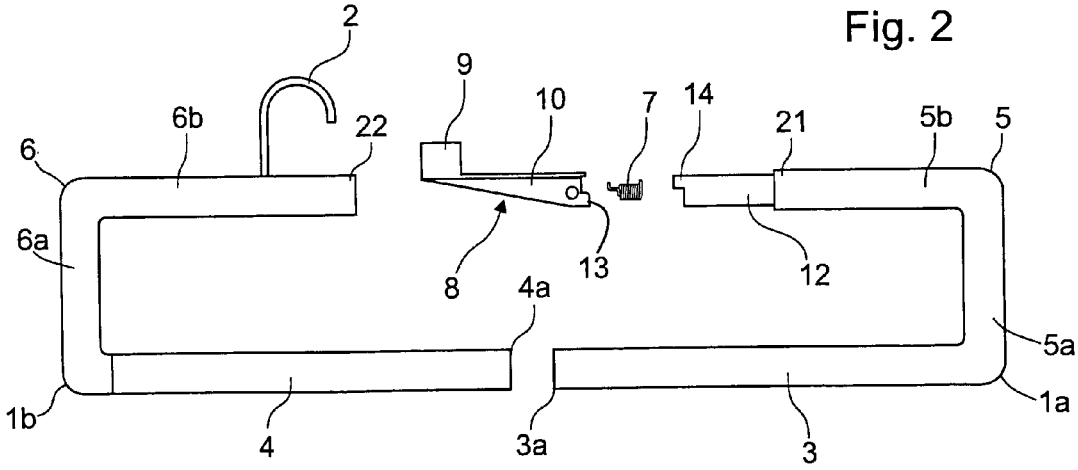
FIG. 2 is a front exploded view of various elements of the hanger shown in FIG. 1.
Figure 3:
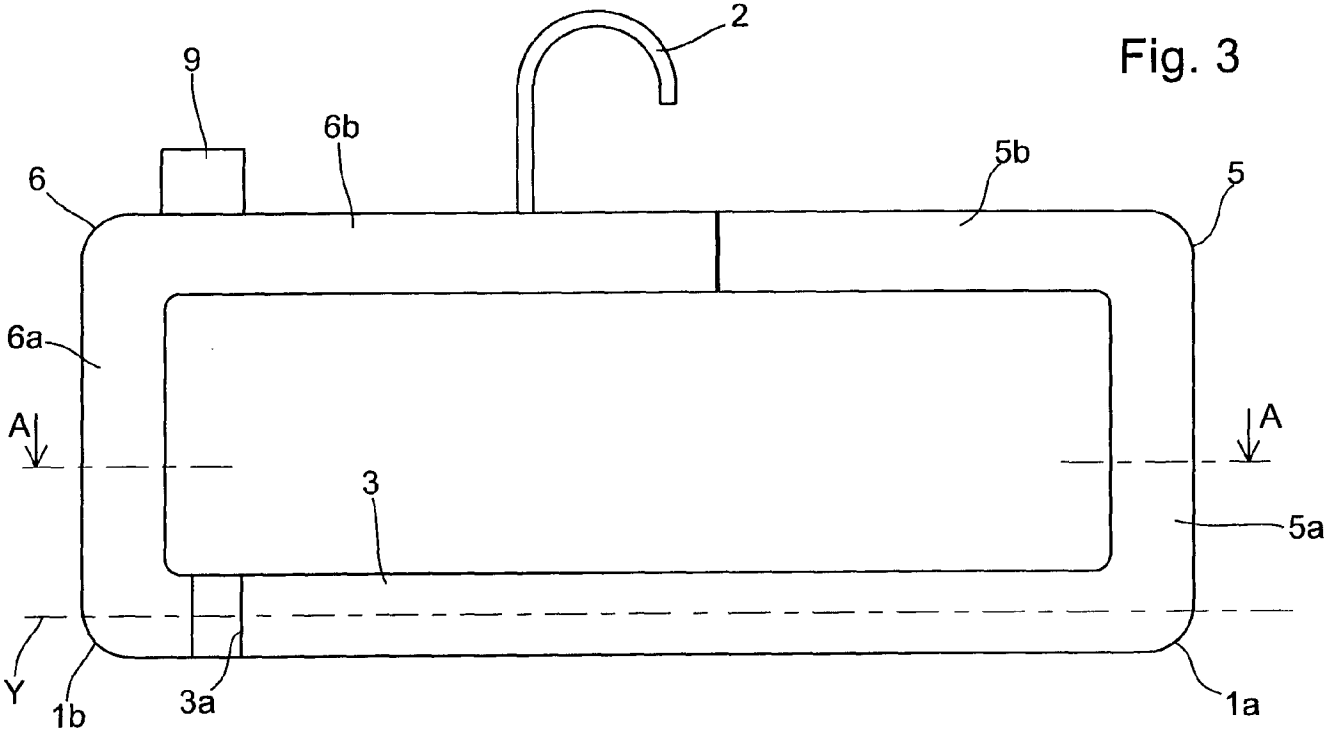
FIG. 3 is a front view of the hanger shown in FIG. 1.

FIG. 1 shows a hanger 1 of the type intended to be hanged by hanging mechanism 2, for example of the hook type. According to one embodiment, the hanger 1 includes a fixed arm 1*b* and a mobile arm 1*a* mobile in relation to the fixed arm between an open position and a position where the fixed and mobile arms are in mutual contact. This mutual contact defines a clipping position of the hanger. The arm 1*a* may be mobile in rotation around a rotation axis X.

In clipping position, the arms 1*a*, 1*b* are able to hold by clipping a garment arranged between the fixed and mobile arms. A garment means for example a skirt, pants, Bermuda shorts, a towel, or the like.

The hanger 1 includes elastic mechanism 7 arranged to hold the mobile arm 1*a* and the fixed arm 1*b* in mutual contact on at least one part of their respective surfaces. The elastic mechanism is conFig.d to exert a stress on the mobile arm so as to firmly push it against the fixed arm to allow a quite heavy garment to be held. When the mobile arm 1*a* is moved away from the fixed arm 1*b* by opposing the elastic mechanism 7 the garment previously clipped is released and/or another garment may be inserted between the arms. This configuration is referred to as open position.

According to one embodiment, each arm 1*a*, 1*b* includes a clipping stick 3, 4 and a linking stick 5, 6. Globally, the clipping sticks 3, 4 each have an elongated shape spreading according to a longitudinal direction Y substantially parallel to the rotation axis X, with a non-free end attached to one of the linking sticks 5, 6 and a free end 3*a*, 4*a*. It is to be noted that the elongated shape of the clipping sticks 3, 4 is also substantially parallel to the direction of the movement made by the user to place or remove a garment. The clipping sticks thus perform a certain guiding of the garment when it is introduced into the hanger 1. Each linking stick 5, 6 includes a radial part 5*a*, 6*a* spreading according to a direction substantially perpendicular to the rotation axis X from the non-free end of a clipping stick 3, 4 up to the rotation axis X, and a longitudinal part 5*b*, 6*b* substantially spreading according to the rotation axis X between the radial part 5*a*, 6*a* of the linking stick and the longitudinal part of the other linking stick. Thus, the hanger 1 has a general shape of frame in clipping position.

The mobile arm 1*a* has in relation to the fixed arm 1*b* an angular displacement included between 7° and 90°. In one embodiment, this angular displacement is included between 10° and 45°, for example around 15°. As it will be explained below, the hanger 1 may be formed so as to allow the hand holding a garment to freely pass, above the clipping sticks 3, 4, when positioning and removing the garment between both clipping sticks. Thus, no element of the hanger 1 gets in the way of the hand during this positioning or removing movement. Consequently, the minimum distance required between the clipping sticks 3, 4 in open position is mainly imposed by the maximum thickness of the garment to be clipped. The distance between both clipping sticks 3, 4 must therefore be able to reach a value higher than this maximum thickness. The angular displacement of the mobile arm must allow this distance to be reached between the clipping sticks 3, 4.

The clipping sticks 3, 4 have facing faces intended to mutually come into contact in the absence of garment arranged between them.

Figure 4:
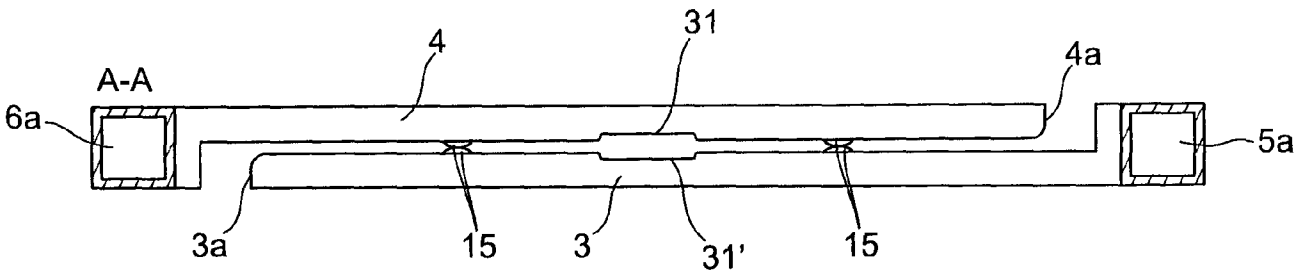
FIG. 4 is a view according to the A-A section of the hanger of FIG. 3.
Figure 10:
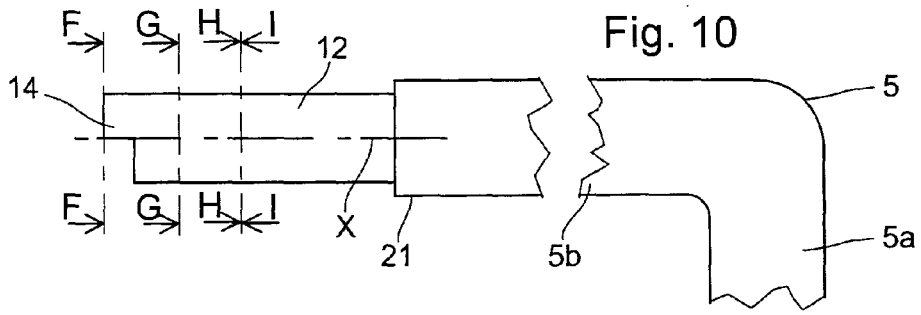
FIG. 10 is a side view of a shaft at an end of the mobile arm.
Figures 11, 12, 13, 14:
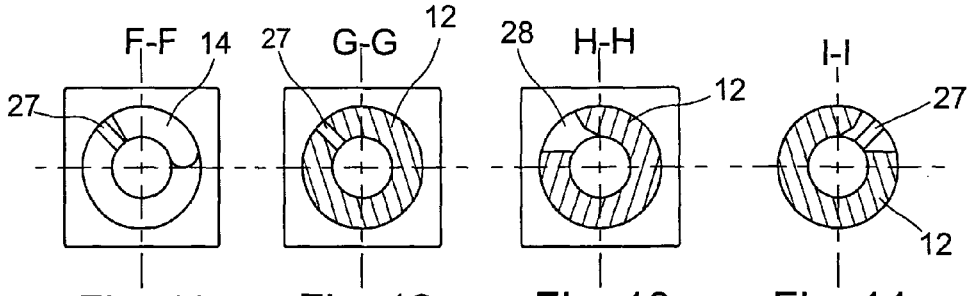
FIG. 11 is a view according to arrows F of the end of the mobile arm of FIG. 10, FIGS. 12 to 14 are views according to the sections G-G, H-H and I-I of the end of the mobile arm of FIG. 10.
Figure 15:
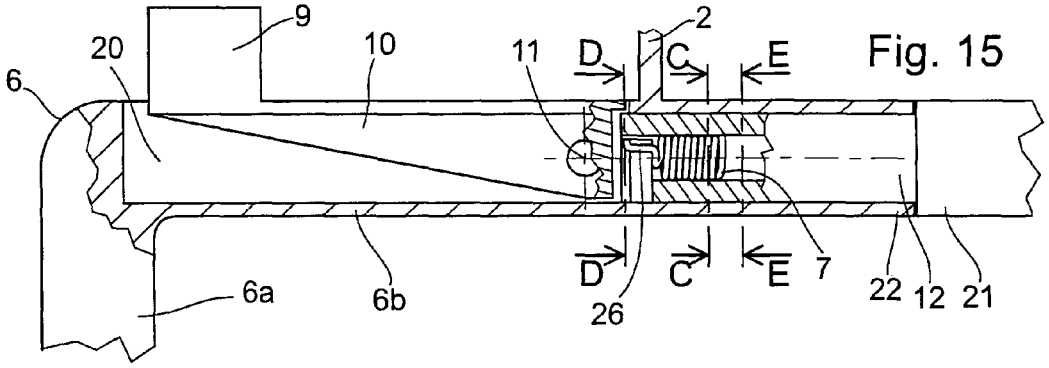
FIG. 15 is a view partially in longitudinal section of a part of the hanger shown in FIG. 1, showing the position of the control mechanism and the elastic mechanism when they are not operated.
Figures 16, 17, 18:
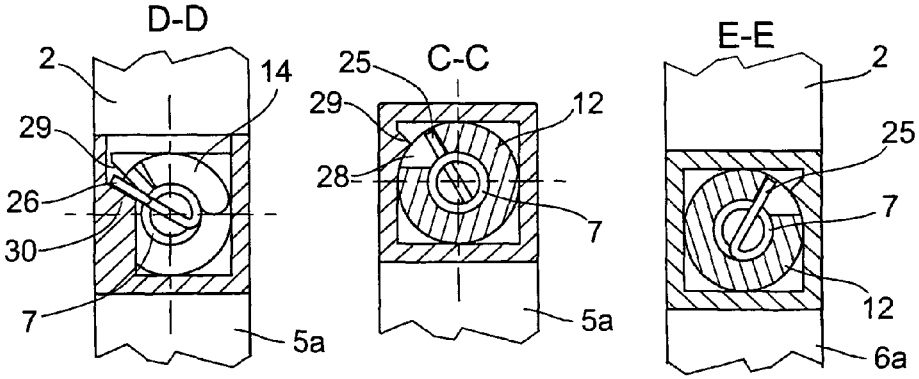
FIGS. 16 to 18 are views according to the sections D-D, C-C and E-E of the part of hanger of FIG. 15.
Figure 21:
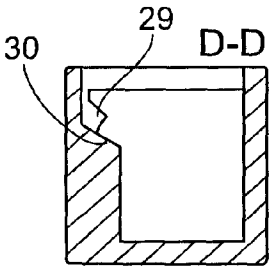
FIGS. 21 to 22 are views according to the sections D-D and C-C of the part of hanger of FIG. 20, FIG. 23. is a top view of the part of hanger of FIG. 20.
Figure 22:
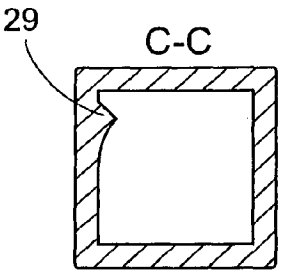
Figure 19:
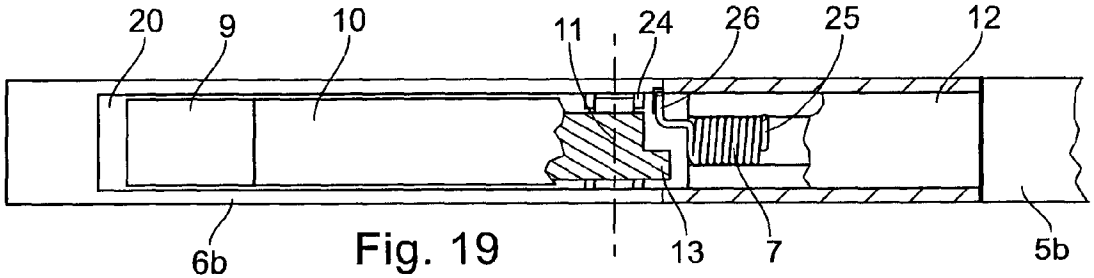
FIG. 19 is a top view, partially in section of the part of hanger of FIG. 15.
Figure 20:
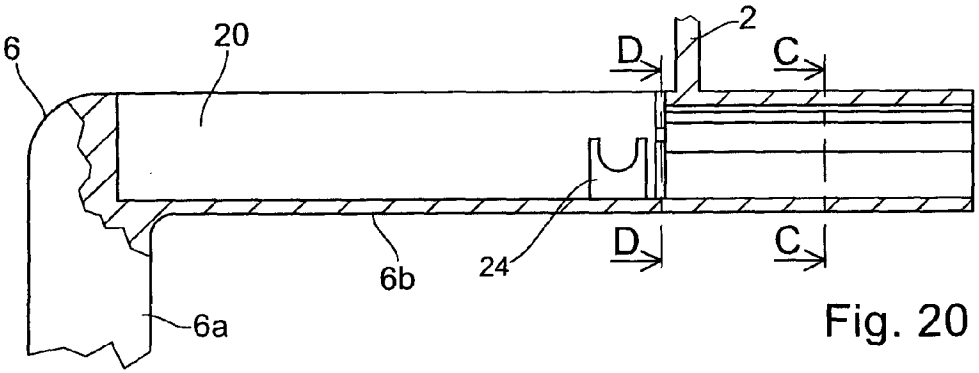
FIG. 20 is a view partially in longitudinal section of a part of the hanger shown in FIG. 1, in which the operating element has been removed.
Figure 23:
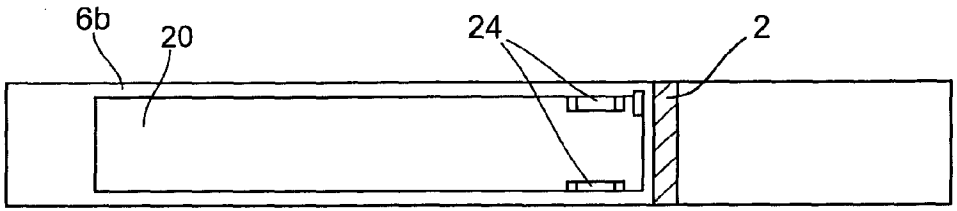
Figure 27:
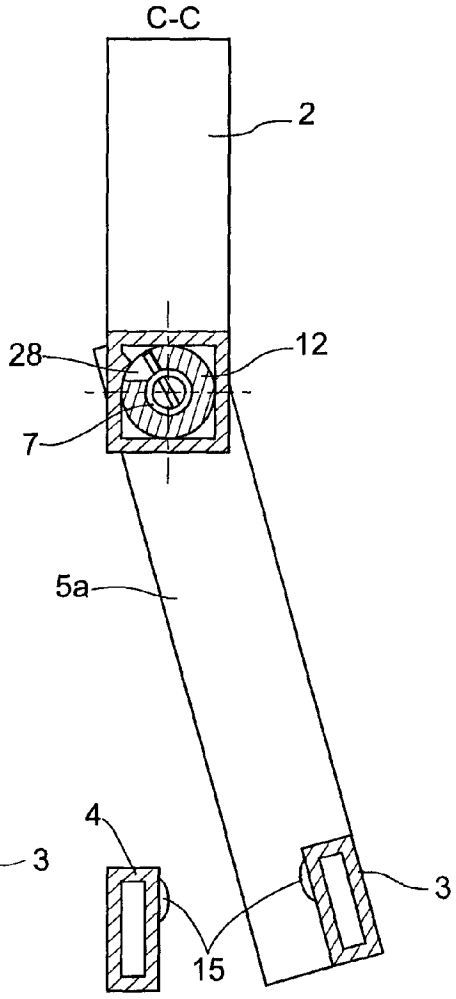
FIGS. 26 and 27 are views according to the sections D-D and C-C of the part of hanger of FIG. 8, in open position.
Figure 26:
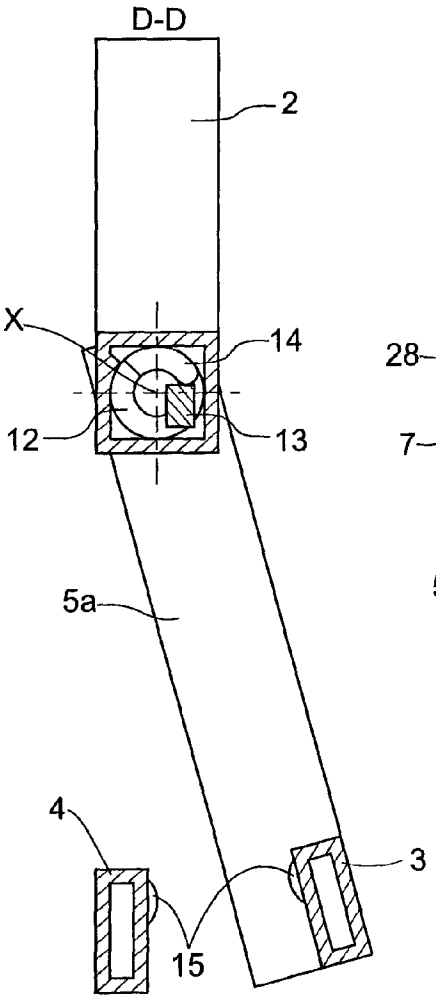
Figure 25:
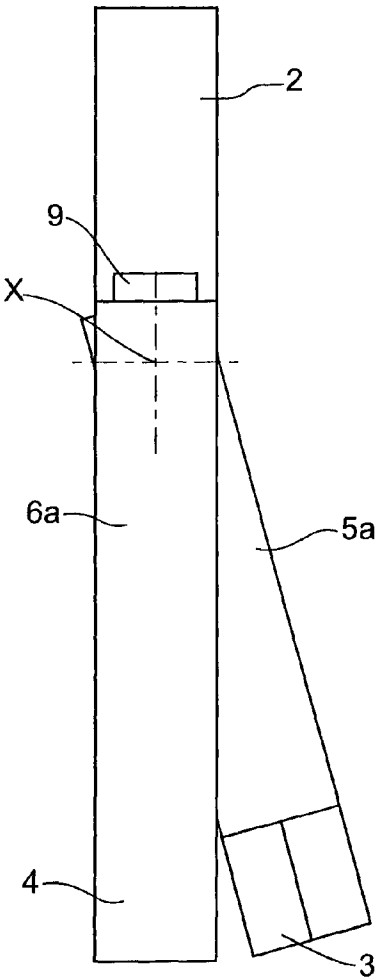
FIG. 25 is a side view of the hanger in open position.
Figure 24:
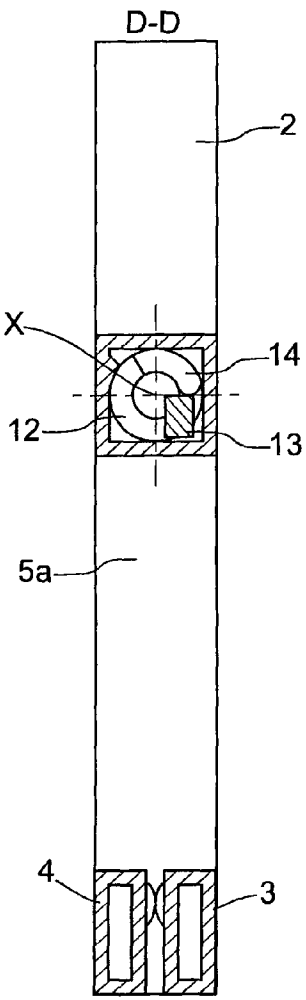
FIG. 24 is a view according to the section D-D of the part of hanger of FIG. 5.

The facing faces of the clipping sticks 3, 4 may be provided with protrusions 15 shown in FIG. 4. The protrusions 15 are arranged in order to come into contact with one another. Thus, the contact surface between the facing faces of the clipping sticks 3, 4 is limited to the contact surface of the protrusions 15. The aim of the protrusions 15 is to perform better holding of a garment even in the presence of an additional thickness such as a button or seam. Indeed, the possible additional thicknesses of the garment may be housed in the space between the clipping sticks 3, 4 which are maintained slightly opened by the protrusions 15. The protrusions 15 may be made from a material which friction coefficient allows friction between the clipping sticks 15, 3 and the garment to be increased so that the garment is properly held. For example, the protrusions 15 are made in a polymer-based material. A recess 31 may also be provided on at least one of the clipping sticks 3, 4, which is intended to receive a thick seam and arranged substantially in the middle of the clipping stick. The recess 31 allows the clipping sticks 3, 4 to be homogeneously kept into contact. In FIG. 4, the hanger 1 includes two facing recesses 31, 31'.

As shown in FIG. 1, the mobile clipping stick 3 extends so that its free end 3*a* nearly touches the radial part 6*a* of the fixed linking stick 6. The non-free end of the mobile clipping stick 3 is attached to an end of the mobile linking stick 5 on the side of the radial part 5*a*. Likewise, the fixed clipping stick 4 extends so that its free end 4*a* nearly touches the radial part 5*a* of the mobile linking stick 5. The non-free end of the fixed clipping stick 4 is attached to an end of the fixed linking stick 6 on the side of the radial part 6*a*. The two other ends 21, 22 of the linking sticks 5, 6 on the side of the longitudinal parts 5*b*, 6*b* cooperate to form a pivot link allowing the mobile clipping stick 3 to move away from the fixed clipping stick 4.

Figure 30:
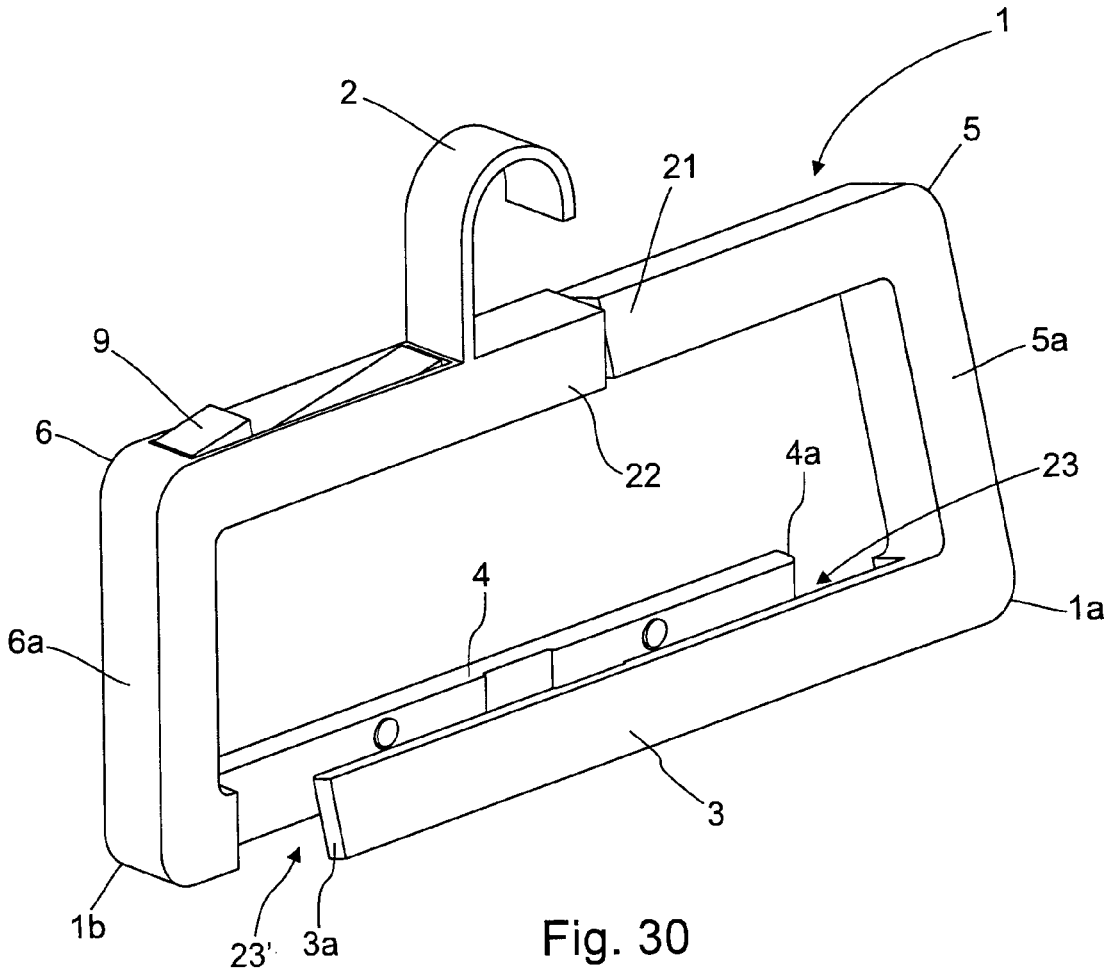
FIG. 30 is a perspective view of the hanger in open position.
Figure 31:
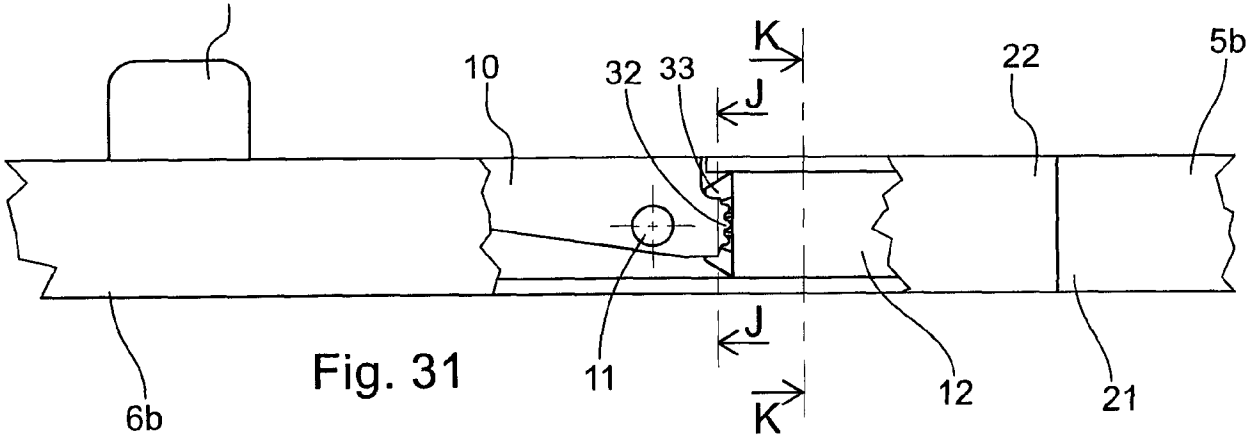
FIG. 31 is a front view partially in longitudinal section of a part of the hanger shown in FIG. 1, according to a second embodiment, showing a position of the control mechanism when it is not operated.
Figure 32:
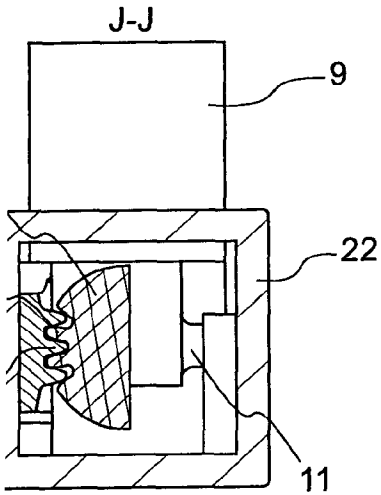
FIG. 32 is a view according to the section J-J of the hanger of FIG. 31.
Figure 33:
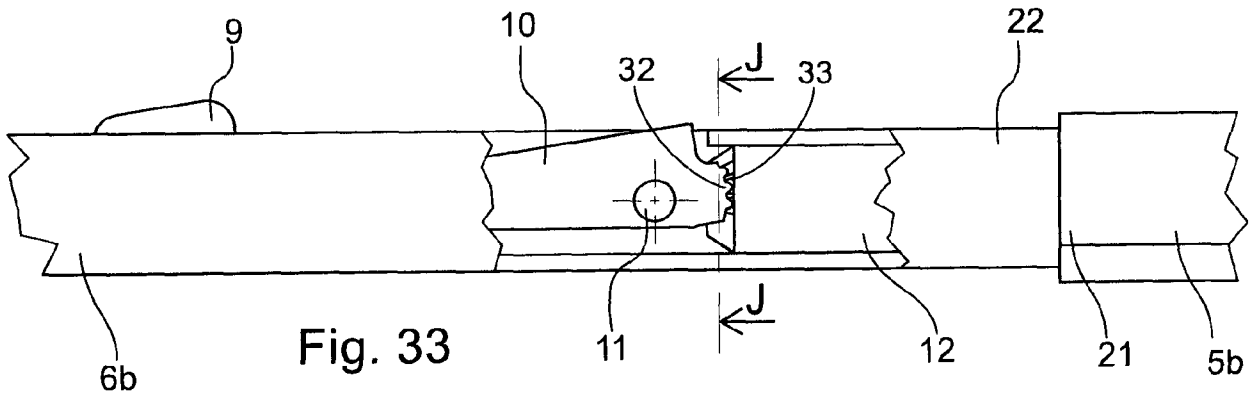
FIG. 33 is a front view partially in longitudinal section of a part of hanger shown in FIG. 31, showing a position of the control mechanism when it is operated.
Figure 34:
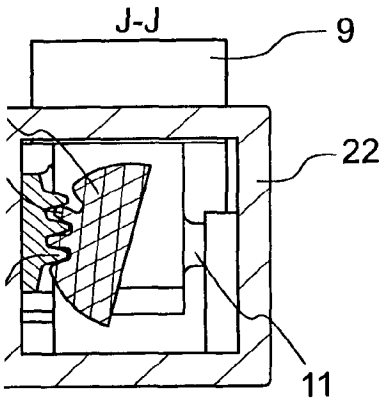
FIG. 34 is a view according to the section J-J of the part of hanger of FIG. 33.

This arrangement allows the use of the hanger 1 to be facilitated, because the user may slip the garment between both clipping sticks 3, 4 in an opening 23 obtained when the hanger is in open position, by a movement substantially parallel to the longitudinal direction without being blocked by elements of the hanger 1. The location of this opening 23 appears in FIG. 30 which shows the hanger 1 in open position.

It is to be noted that the hanger has in open position another opening 23' formed between the end 3*a* of the clipping stick 3 and the radial stick 6*a* of the linking stick 6, the opening 23 being usable by right-handed people and the opening 23' by left-handed people.

The radial parts 5*a*, 6*a* of the linking sticks 5, 6 are shown as substantially forming a right angle with the clipping sticks 3, 4. Thus, the hanger 1 shown in the drawings has the shape of a substantially rectangular frame, when it is in clipping position. It may be considered that the radial part 5*a*, 6*a* of the linking sticks 5, 6 forms an acute angle or an arc of circle with the clipping sticks 3, 4. A hanger 1 of trapezoidal or elliptical shape may thus be considered.

The longitudinal parts 5*b*, 6*b* of the linking sticks 5, 6 which define the rotation axis X of the mobile arm 1*a* are substantially parallel to the clipping sticks 3, 4. This facilitates assembling the arms 1*a*, 1*b* by the linking sticks 5, 6.

The linking stick 6 of the fixed arm 1*b* may be formed to act as an area for handling the hanger by the hand of the user. Particularly, the radial part 6*a* of the linking stick 6 may be long enough to receive the hand of the user and to guarantee an easy grip of the hanger 1 while it is handled. The length of the radial part 5*a*, 6*a* of the linking sticks 5, 6 also conditions the width of the opening 23, 23' through which a garment may be introduced into the hanger 1 and removed out of it.

Each arm 1*a*, 1*b* may be formed by a single monoblock part. It may nevertheless be considered that each linking stick 5, 6 is brought fixed onto one of the clipping sticks 3, 4.

The mobile arm 1*a* is moved away from the fixed arm 1*b* by a control mechanism 8 at least partially arranged on the fixed arm. The control mechanism 8 includes an operating element 10 located on the fixed arm, so as to accept at least one degree of freedom in relation to the fixed arm. The degree of freedom may be a degree of freedom in rotation. Thus, the rotation of the operating element 10 may be performed around a rotation axis 11 substantially perpendicular to the rotation axis X of the mobile arm 1*a*.

According to another possibility, the operating element 10 may accept one degree of freedom in translation or rotation according to an axis substantially parallel to the rotation axis X. It may thus particularly be provided that the operating element 10 turns around the rotation axis X.

The operating element 10 includes a support area 9 forming for example a button, on which the user exerts pressure to operate the operating element 10. The arrangement of the operating element 10 on the hanger allows the user to operate it with the hand which holds the hanger 1 at the same time.

This arrangement allows in particular the user to operate the control mechanism 8 with the thumb of the hand which other fingers and palm hold the radial part 6*a* of the fixed linking stick 6.

Thus, the arrangement of the linking stick 6 of the fixed arm and the control mechanism allow the user to hold with a same hand the hanger by the fixed linking stick 6 and to operate the control mechanism 8. The use of the hanger 1 according to the invention is therefore particularly simple and intuitive.

FIGS. 5 to 9 and 24 to 27 show the operation of the control mechanism 8 and the opening of the hanger 1. In the linking area of the longitudinal parts 5*b*, 6*b* of the two linking sticks 5, 6, the longitudinal part 5*b* includes an end 21 having a shape substantially complementary to that of the end 22 of the longitudinal part 6*b*. The end 21 forms for example a rotation shaft 12 intended to be inserted into the end 22 of the fixed linking stick 6. To that end, the end 22 of the stick 6 is shaped to form a sleeve around the shaft 12, and thus, act as bearing so as to maintain and guide the shaft in rotation around the rotation axis X.

The operating element 10 is arranged in a housing 20 of the fixed linking stick 6. The hanger 1 is arranged so that the support area 9 of the operating element 10 forms a projection outside the fixed arm 1*b*. Thus, the user freely reaches the support area 9.

The operating element 10 and the fixed arm 1*b* include a mechanical coupling forming a pivot link of the operating element 10 in the housing 20. The coupling may include lateral protrusions intended to come into a receiving part 24. The receiving part 24 may be brought fixed into the housing 20 or formed in the housing 20. The lateral protrusions may be rounded so as to act as rotation axis 11 of the operating element 10. The receiving part 24 then has a concave rounded shape complementary to the protrusions, so as to receive the lateral protrusions and thus act as bearing centered on the rotation axis 11 of the operating element 10.

The operating element 10 and the shaft 12 also include a mechanical coupling arranged so that a pressure exerted on the operating element 10 drives in rotation the mobile arm 1*a* in relation to the fixed arm 1*b* toward the open position, against the elastic mechanism 7, and a release of the operating element tends to make the shaft 12 turn in the opposite direction up to the clipping position of the arms 1*a*, 1*b*, under the effect of the elastic mechanism.

The coupling between the operating element 10 and the shaft 12 includes for example an extension 13 of the operating element 10 spreading beyond the rotation axis 11 at an end opposite to the support area 9, which cooperates with a contact area 14 attached to the mobile arm 1*a*. The extension 13 includes for example a finger 13 which may have a substantially parallelepiped shape. The contact area 14 may be formed on the shaft 12 and have a profile in the shape of an arc of circle extending a part of the shaft 12.

Thus, when the user operates the operating element 10, the finger 13 moves in the longitudinal plane of the hanger 1 parallel to the rotation axis X and in a direction substantially perpendicular to this axis, and exerts on the contact area 14 a force having at least one component in this plane. The force thus generates a torque tending to make the mobile arm 1*a* turn around the rotation axis X. The cooperation of the fixed 1*b* and mobile 1*a* arms in the longitudinal parts 5*b*, 6*b* of the linking sticks 5, 6 therefore allows the rotation movement of the operating element 10 around the axis 11 to be transformed into a rotation movement of the mobile arm 1*a* around the axis X.

When the user releases the operating element 10, the elastic mechanism 7 tends to make the shaft 12 turn in the opposite direction up to the clipping position. Meanwhile, the shaft 12 generates a push of the contact area 14 onto the finger 13 so as to cause a rotation of the control element 10 up to the rest position thereof.

According to a variation shown in FIGS. 31 to 37, the operating element 10 includes at its end opposite to the support area 9 an extension beyond the rotation axis 11 including a part of conical tooth gear 32. The part of conical tooth gear 32 is arranged on the extension 13 so as to come into contact with a part of conical tooth gear 33 of complementary shape arranged on the mobile arm 1*a*. The part of gear 33 may be formed on the shaft 12. According to this variation, the parts of gears 32, 33 cooperate in the same way as that described above for the finger 13 and the contact area 14.

The use of parts of conical tooth gears 32, 33 allows the operating forces to be distributed on the surface of the various teeth of the part of gear, for example three on the operating element 10. Thus, the constraints exerted between the various parts of the hanger are limited. The robustness of the hanger 1 is improved.

In one embodiment, the operating element 10 is mounted in translation on the fixed arm 1*b* according to a direction substantially parallel to the rotation axis X. The operating element 10 and the mobile arm 1*a* may then be mechanically coupled by a cam-shaped profile and a contact finger, which are arranged to cooperate so that a translation of the operating element toward the end 22 of the fixed linking stick 6 causes the finger to relatively slide on the cam-shaped profile which causes a rotation of the shaft 12 around its rotation axis X.

When the user releases the operating element, the elastic mechanism 7 tends to make the shaft 12 turn in reverse direction until reaching a position in which the hanger is in its clipping position. Meanwhile, the shaft 12 causes the finger to relatively slide on the cam-shaped profile, causing a translation of the control element up to the rest position thereof.

Thus, the cooperation of the mobile 1*a* and fixed 1*b* arms in the linking area between the two arms allows the translation movement of the operating element to be transformed into a rotation movement of the mobile arm around the axis X.

Figure 38:
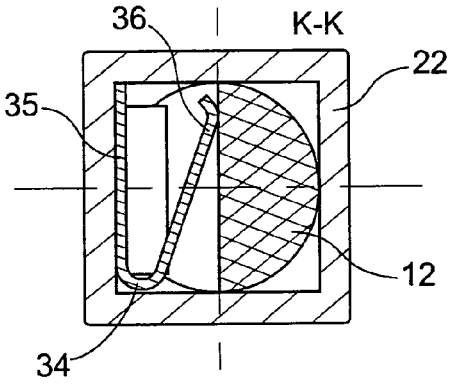
FIG. 38 is a transverse section view according to the section K-K of FIG. 31 according to a variation in which the elastic mechanism is a leaf spring.
Figure 35:
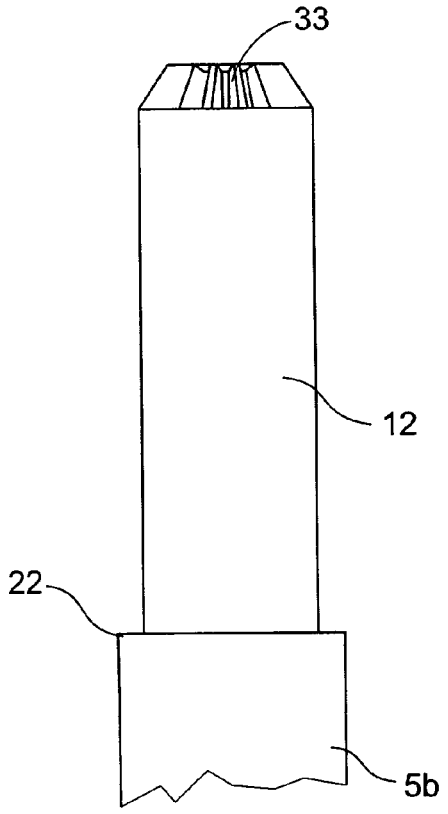
FIG. 35 is a side view of the shaft of the hanger shown in FIGS. 31 to 34, provided with a part of conical tooth gear.
Figure 36:
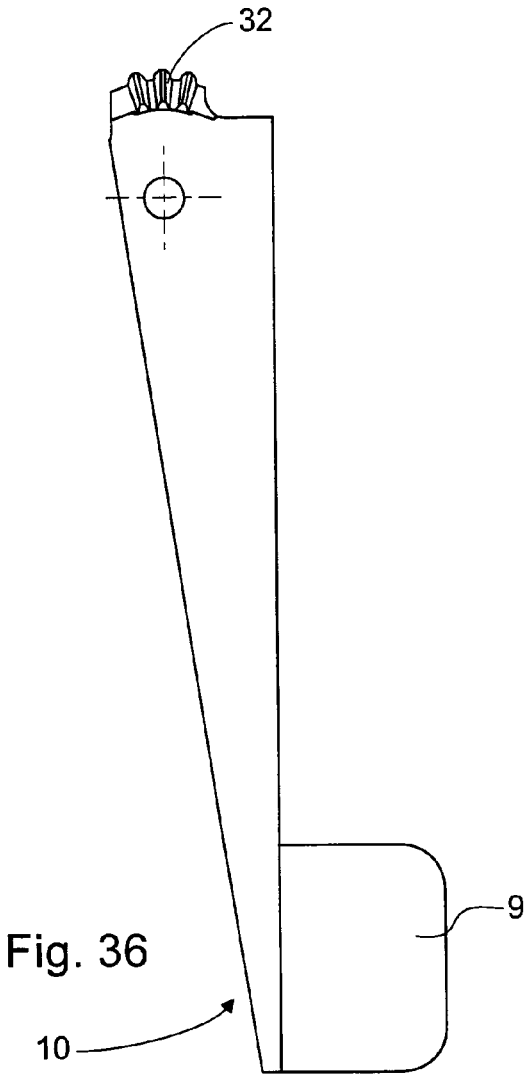
FIG. 36 is a side view of the operating element of the hanger shown in FIGS. 31 to 35.
Figure 37:
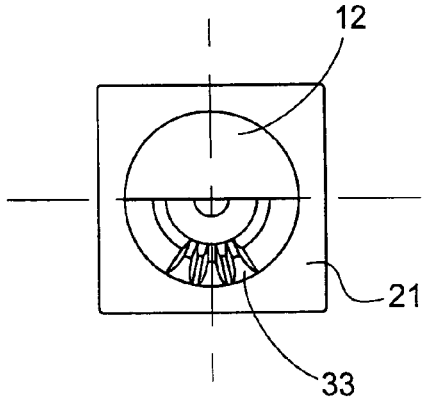
FIG. 37 is a front view of the shaft of FIG. 35.

According to one embodiment, shown in FIG. 38, the elastic mechanism includes a leaf spring 34. The leaf spring 34 is arranged in a housing provided between the shaft 12 of the mobile arm 1*a* and the fixed arm 1*b*. The shaft 12 is truncated in its central part on a sector of around 180° and on a length substantially equal to the width of the leaf spring 34.

The leaf spring 34 is placed into the truncated part of the shaft 12. Then the shaft 12 is introduced into the end 22 of the fixed linking stick 6, as shown in FIG. 38. The leaf spring 34 may be arranged in V shape, one end 35 of which comes into contact with an interior face of the end 22 around the shaft 12, and another end 36 of which comes into contact with a wall of the truncated part of the shaft 12. The end 35 is in contact with the fixed arm 1*b* and the end 36 is in contact with the mobile arm 1*a*. The result is that the spring 34 exerts on the mobile arm a force tending to bring back and hold the mobile arm against the fixed arm.

It may be provided that the leaf spring 34 is equipped with a backstop for example of the harpoon type. Thus, once the shaft 12 provided with the leaf spring 34 is inserted into the end 22, the reverse movement for removing the shaft 12 out of the end 22 is impossible due to the presence of the backstop. The hanger therefore cannot be disassembled. The fact that the hanger cannot be disassembled allows it to be secure for the user. Indeed, the spring 34 having a significant spring rate, the user might get injured at disassembling it.

According to a second embodiment, the elastic mechanism 7 includes a torsion spring 7, for example of helical type. The spring 7 is inserted through an end 25 into an axial housing provided in the shaft 12. The end 25 slides along a slot 27 longitudinally extending into the wall of the shaft 12. The slot 27 opens onto a lock housing 28, at a certain depth in the housing of the shaft 12.

The shaft 12 provided with the spring 7, is inserted into the end 22 of the fixed linking stick 6. The end 22 includes on its internal wall intended to be in contact with the end of the shaft 12 a relief forming a stop 29 longitudinally extending from the end 22. The spring 7 includes another end 26 arranged to lean against this stop 29. The spring 7 is constrained by the stop 29 during its insertion into the fixed arm 1*b*.

At a certain depth in the end 22 of the linking stick 6, the positioning stop 29 stops to be replaced by another relief forming a locking stop 30 in rotation for the spring.

The locking stop 30 is arranged so that the torsion constraint it exerts on the spring 7 is lower than that exerted by the positioning stop 29. The relative angular position between the wall forming the locking housing 28 and the locking stop 29 keeps the spring 7 in a constrained state in torsion. The constraint generates, even in clipping position, a torque between the fixed 1*b* and mobile 1*a* arms. The torque is sufficient to exert a clipping force of the mobile arm 1*a* onto the fixed arm 1*b*, allowing the garment to be held by clipping.

The positioning stop 29 and the locking stop 30 may also have walls forming a stop in longitudinal translation for the spring 7. The positioning stop 29 may be arranged so that once the end 26 of the spring is leaning against the locking stop 30 it is opposed to the sliding of the second end 26 of the spring 7 toward the end 22 of the fixed linking stick 6. The spring 7 cannot be extracted from the fixed linking stick 6 any longer. Likewise, the slot 27 and the locking housing 28 may also be configured to be opposed to the sliding of the first end 25 of the spring 7 toward the end 21 of the mobile arm 1*a*. Thus, the spring 7 cannot be extracted from the mobile linking stick 5 any longer. This arrangement prevents the spring 7 from being removed once the end 25 is in the locking housing 28 and the end 26 is leaning against the locking stop 30.

Thus, the hanger cannot be disassembled. As in the embodiment with the spring 34, previously described, the fact that the hanger cannot be disassembled allows it to be secure for the user.

The following description relates to an embodiment including a torsion spring, and implying the finger 13 cooperating with the contact area 14. This description applies to embodiments in which the torsion spring 7 is replaced by another type of spring such as a leaf spring, and/or in which another mechanical coupling between the operating element 10 and the shaft 12, such as the conical tooth gears 32, 33, replaces the combination finger 13, contact area 14.

The clipping force exerted by the mobile clipping stick 3 on the fixed clipping stick 4 must be significant enough to hold a garment reliably, even if it is heavy. Now this force is generated by the torque the spring 7, 34 exerts onto the mobile arm. Consequently, the torque exerted by the spring must be relatively significant.

In addition, the force exerted by the finger 13 on the contact area 14, or by the gear part 32 on the gear part 33, to drive the mobile arm in rotation around the rotation axis X must fight the torque generated by the spring 7, 34. The force exerted by the finger 13 or the gear part 32 must therefore be equally significant.

Consequently, for the user to easily operate the opening of the hanger, the force that s/he must exert on the support area 9 must be reduced in relation to the force that the finger 13 or the gear part 32 must exert on the contact area 14 or the gear part 33. It is generally considered that the maximum force that a person can easily exert with his/her thumb is around 15 Newton. To that end, it is provided that the distance between the rotation axis 11 of the operating element 10 and the finger 13 or the gear part 32 is significantly lower than the distance between the same rotation axis 11 and the support area 9. In the following description:

D1 refers to the distance between the rotation axis X and the mobile 3 and fixed 4 clipping sticks, d1 refers to the distance between the rotation axis X and the contact area 14 or the gear part 33, D2 refers to the distance between the rotation axis 11 of the operating element 10 and the support area 9, d2 refers to the distance between the rotation axis 11 of the operating element 10 and the finger 13 or the gear part 32, Fpincement refers to the minimum force that the mobile clipping stick 3 must exert on the fixed clipping stick 4 to hold a garment reliably, Futilisateur refers to the minimum force that the user must exert on the support area 9 to move the mobile arm away from the fixed arm.

The mobile arm 1*a* is formed so as to allow the travel of the mobile clipping stick 3 in relation to the travel of the contact area 14 or the gear part 33 to be reduced. To that end, the ratio D1/d1 is chosen so that the mobile clipping stick 3 significantly moves away from the fixed clipping stick 4, while the contact area 14 or the gear part 33 performs a relatively limited travel. The ratio is chosen so that the opening 23, 23' formed between the mobile 3 and fixed 4 clipping sticks allows a garment to pass.

It may be provided that the opening dimension is around 30 millimeters, the dimension corresponding to the distance between the mobile 3 and fixed 4 clipping sticks in open position.

In the example described, the distance d1 is around 7 millimeters.

The choice of the distance D1 results from a compromise between several parameters. In particular, the distance D1 corresponds to the length of the radial part 5*a*, 6*a* of the linking sticks 5, 6. Now the radial part 6*a* defines the handling area of the hanger 1. The radial part 6*a* must thus have dimensions able to receive the hand of the user. In addition, for a given angular gap of the mobile arm 1*a* in relation to the fixed arm 1*b*, the distance D1 defines the distance between the fixed 4 and mobile 3 clipping sticks. The greater the distance D1 is, the easier it is to introduce a garment between the arms 1*a*, 1*b*. The distance D1 thus defines the dimension of the openings 23, 23' through which the user introduces a garment into the hanger land removes a garment from the hanger 1. In addition, the distance D1 conditions the force exerted by the mobile arm 1*a* on the fixed arm 1*b* for a given torque generated by the spring 7, 34.

The distance D1 may be chosen between 75 and 150 millimeters. In addition, the distance d1 is chosen so as to limit obstruction of the pivot link. The ratio D1/d1 may be between 5 and 30.

The operating element 10 is formed to allow the stress exerted between the finger 13 and the contact area 14 or between the gear parts 32, 33 to be reduced. To that end, the ratio D2/d2 allows the user to generate significant stress on the finger 13 or the gear part 32 by exerting relatively low stress on the support area 9. In particular, this ratio is determined so that the stress exerted on the support area 9 is significantly lower than the maximal stress a user may generally perform by flexing the thumb. The ratio D2/d2 is in addition chosen so that the stress available on the finger 13 or the gear part 32 is sufficient to oppose the spring 7, 34.

The ratio D2/d2 may be between 5 and 15. In the example described, the distance d2 is around 10 millimeters. The distance D2 results from a compromise between the dimensions of the control mechanism 8, the reduction of the stress which allows the user to easily open the hanger 1 and the adapted travel of the support area 9 to facilitate the operation of the control mechanism 8. In addition, the distance d2 may be chosen so as to limit obstruction of the pivot link.

In the example described, D2 is chosen around 100 millimeters. The displacement of the operating element 10, which may be operated by the thumb of the user is for example around 20 millimeters. In this case, the ratio of D2/d2 is equal to 10, which makes it possible to obtain a stress generated on the finger 13 or the gear part 32 which is ten times higher than the stress generated by the thumb on the support area 9.

When the user wishes to take a garment, s/he takes the hanger by placing one hand on the radial part 6*a* of the fixed linking stick 6. The thumb of the hand is then near the support area 9 of the operating element 10. The user then operates the operating element 10 by pushing the thumb of this hand onto the support area 9. A move of the support area 9 causes a vertical move of the finger 13 or the gear part 32, which drives the contact area 14 or the gear part 33 in rotation around the rotation axis X. The mobile clipping stick 3 is thus moved away from the fixed clipping stick 4. The user can, with the other hand, insert the garment through one of the openings 23, 23' formed between the fixed and mobile clipping sticks. The garment may be inserted between both clipping sticks 3, 4 according to a movement substantially parallel to the longitudinal axis Y of the clipping sticks. Since the length of the radial parts 5*a*, 6*a* defines the dimension of the openings 23, 23' allowing a garment held by this hand to pass, and that beyond the opening 23, 23', the hand of the user does not meet any obstacle up to an opposite end of the hanger, the amplitude of the movement may be substantially equal to the longitudinal dimension of the hanger 1. The hand may indeed go all through the hanger 1 without touching any of these parts. Once the garment is properly placed between the clipping sticks 3, 4, the user releases the pressure exerted on the support area 9. The spring 7, 34 brings the shaft 12 in initial position and therefore the mobile arm 1*a* in its clipping position. The garment is then clipped between both clipping sticks 3, 4. The reverse operations must be performed to release a garment from the hanger clipping.

The invention thus allows a garment to be placed on the hanger 1 and to be removed therefrom by performing particularly simple operations: taking the hanger 1 with one hand, operating the control mechanism 8 with a finger of this hand without it being necessary to move it, moving the other hand in translation to place the garment through the opening 23, 23' defined between both clipping sticks 3, 4, and then releasing the control mechanism 8.

As an example, the hanger 1 according to one embodiment is made in plastic. The number of elements constituting the hanger is limited. In the example described, it includes indeed four different parts. This arrangement of the hanger 1 allows it to be particularly easily and quickly mounted, which reduces assembly costs.

According to the invention, the various elements of the hanger 1 are mutually imbricated so that the cohesion of the hanger 1 does not require any screw or other additional fixing elements. The various elements of the hanger 1 may be formed so that once assembled, they cannot be disassembled.

The hanger may include an indicator specifying the number of times the garment has been worn. The indicator will be useful for the user, so as to give an indication about the cleanliness state and need to wash of the garment.

Figure 28:
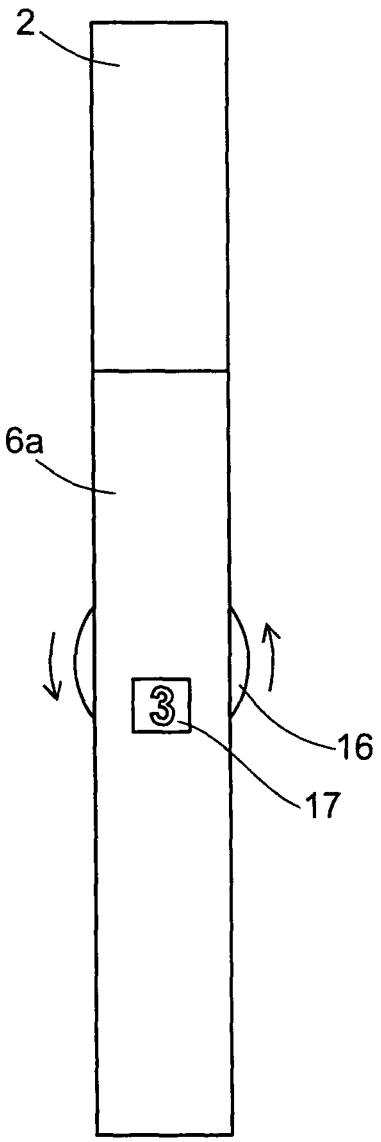
FIG. 28 is a view of a first embodiment of indicator.

As shown in FIG. 28, a thumb wheel 16 provided with figures, for example from 0 to 9, is inserted at least partially into a slot made on a part of the hanger, such as the fixed linking stick 6 or near the hanging mechanism 2. A window 17 makes it possible to visualize the figure on the thumb wheel 16.

Figure 29:
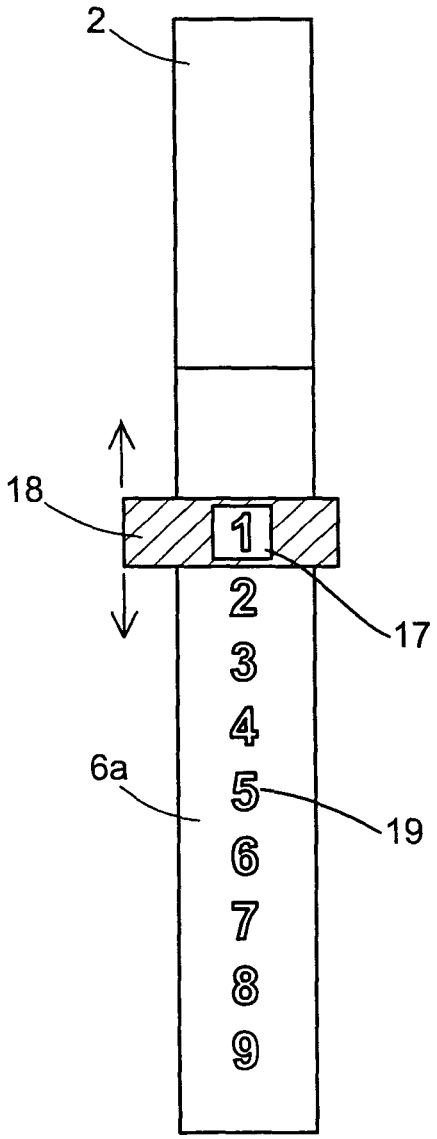
FIG. 29 is a view of a second embodiment of indicator.

According to another possibility shown in FIG. 29, figures, for example from 0 to 9, are specified on a part of the hanger forming a graduated strip 19. For example, the graduated strip 19 is arranged on the same part of the hanger 1 as that provided in the previous embodiment. A cursor 18 including for example a window 17, or a pointer can be moved along the graduated strip 19 to indicate the relevant figure.

The invention allows the use of clipping hangers to be significantly facilitated. In addition, the hanger according to the invention is really easy to assemble and has a limited cost. In addition, it is very robust and secure to use.

It will appear clearly to those skilled in the art that the present invention is susceptible of various embodiments. In particular, the invention is not limited to the hanger in the shape of frame previously described. Indeed, a hanger may be considered, having two arms, each having a free end, the free ends of both arms being arranged near one another in clipping position.

The invention is not limited either to two arms connected to one another. Indeed, it may be provided to fix both arms to one another so that they are mobile in translation one in relation to the other.

It may also be provided that the rotation axis of the two arms is not necessarily parallel to the longitudinal axis of the clipping sticks 3, 4. Indeed, the longitudinal sticks of the linking sticks may meet according to an axis forming an angle with the longitudinal axis of the clipping sticks, so that one of the two openings 23, 23' is wider than the other.

It may also be provided that the rotation axis of the mobile arm is off-center in relation to the longitudinal axis of the end of the fixed linking stick, so that the pivot link between both arms is not necessarily formed in the end of the fixed arm.

In addition, in the previous description, the terms "fixed" and "mobile" have been used only to better understand the description. Admittedly, as the hanger is an item intended to be held in the hand of the user, both terms must be understood in a relative meaning, one in relation to the other. Thus, the "mobile" arm may be intended to be held in the hand, the operating element then being arranged on this arm, whereas the "fixed" arm moves away from the "mobile" arm under the effect of the operating element.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A hanger for holding a garment, wherein the hanger has a shape substantially the same as a frame, the hanger comprising:

a first arm and a second arm together forming the frame, the first arm including a first clipping stick and a first linking stick, the second arm including a second clipping stick and a second linking stick, the first linking stick including a first longitudinal part and a first radial part, the second linking stick including a second longitudinal part and a second radial part, an upper arm defined by the first and second longitudinal parts, a lower arm defined by the first and second clipping sticks, the first radial part linking first ends of the upper and lower arms, the second radial part linking second ends of the upper and lower arms, the first arm mobile relative to the second arm between an open position, wherein the first clipping stick is spaced from the second clipping stick and a clipping position, wherein the first clipping stick is in contact with the second clipping stick;

a spring element configured to urge the frame toward the clipping position, the spring element configured to generate a clipping force between the first and second clipping sticks to allow the garment to be held between the first and second clipping sticks in the clipping position; and a control mechanism configured to urge the first and second arms toward the open position against a bias of the spring element, the control mechanism including an operating element, the control mechanism being movably mounted to the second arm with the operating element being able to be operated by pressure exerted by the hand of a user holding the second arm, the spring element configured to urge the first and second arms towards the clipping position in the absence of pressure exerted on the operating element.

2. The hanger according to claim 1, wherein the first clipping stick has an elongated shape comprising a first free end located in the clipping position near a second non-free end of the second clipping stick and the second clipping stick has an elongated shape comprising a second free end located in the clipping position near a first non-free end of the first clipping stick.

3. The hanger according to claim 1, wherein the first and second longitudinal parts are rotatively fixed to each other and are rotatable around a rotation axis.

4. The hanger according to claim 3, wherein the first and second longitudinal parts are formed to mutually cooperate so as to form a pivot link centered on the rotation axis.

5. The hanger according to claim 3, wherein the first longitudinal part of the first linking stick is provided at its end intended to be linked to the second longitudinal part of the second linking stick, with a rotation shaft intended to be inserted into the second longitudinal part, the rotation shaft configured to cooperate with the operating element.

6. The hanger according to claim 3, wherein the operating element accepts in relation to the second arm at least one degree of freedom in translation along a direction substantially parallel to the rotation axis.

7. The hanger according to claim 3, wherein the operating element comprises an extension intended to cooperate with a contact area formed in the first arm so that operating the operating element drives in rotation the first arm in relation to the second arm around the rotation axis.

8. The hanger according to claim 7, wherein the operating element is formed to allow stress to be reduced between the extension and a support area so that the stress exerted on the support area, necessary to move the first and second arms to the open position, is significantly lower than a maximal stress which may usually exert by flexing the user's thumb.

9. The hanger according to claim 7, wherein the first arm is formed to reduce the relative travel of the first arm in relation to the travel of the contact area.

10. The hanger according to claim 3, wherein the operating element comprises a part of a conical tooth gear configured to cooperate with a part of a conical tooth gear of complementary shape arranged on the first arm so that operating the operating element drives the first arm in rotation around the rotation axis.

11. The hanger according to claim 1, wherein the second radial part is formed to act as an area for handling and holding the hanger by the hand of the user.

12. The hanger according to claim 1, wherein the operating element accepts in relation to the second arm at least one degree of freedom in rotation.

13. The hanger according to claim 1, wherein the spring element comprises a spring comprising a first end in contact with the first arm and a second end in contact with the second arm to exert on the first and second arms a force tending to bring and hold the first and second arms in the clipping position.

14. The hanger according to claim 1, further comprising:

an indicator specifying a number of times the garment clamped by the hanger has been worn.

* * * * *